US009198522B1

(12) United States Patent
Wei

(10) Patent No.: US 9,198,522 B1
(45) Date of Patent: Dec. 1, 2015

(54) CUSHION DEVICE FOR AN EXERCISING APPARATUS

(71) Applicant: CLOUD FITNESS CO., LTD., Taichung (TW)

(72) Inventor: Tsao-Kuang Wei, Taichung (TW)

(73) Assignee: CLOUD FITNESS CO., LTD., Taichung (TW)

( * ) Notice: Subject to any disclaimer, the term of this patent is extended or adjusted under 35 U.S.C. 154(b) by 0 days.

(21) Appl. No.: 14/520,035

(22) Filed: Oct. 21, 2014

(51) Int. Cl.

| | |
|---|---|
| ***A47C 7/02*** | (2006.01) |
| ***A47C 27/08*** | (2006.01) |
| ***A47C 1/00*** | (2006.01) |
| ***A47C 7/18*** | (2006.01) |
| ***A47C 21/04*** | (2006.01) |

(52) U.S. Cl.
CPC ..... *A47C 27/081* (2013.01); *A47C 1/00* (2013.01); *A47C 7/18* (2013.01); *A47C 21/042* (2013.01)

(58) Field of Classification Search
CPC ..... A47C 7/021; A47C 4/54; B62J 1/26
USPC ..... 297/219.1, 219.11, 284.1, 284.3, 284.6, 297/452.41; 5/653, 654, 901
See application file for complete search history.

(56) References Cited

U.S. PATENT DOCUMENTS

| | | | | |
|---|---|---|---|---|
| 4,741,057 | A * | 5/1988 | Rosier et al. | 5/707 |
| 4,753,480 | A * | 6/1988 | Morell | 297/452.27 |
| 6,018,832 | A * | 2/2000 | Graebe | 5/654 |
| 6,189,168 | B1 * | 2/2001 | Graebe | 5/644 |
| 6,510,573 | B1 * | 1/2003 | Grabe | 5/644 |
| 6,519,797 | B1 * | 2/2003 | Brubaker et al. | 5/654 |
| 6,623,080 | B2 * | 9/2003 | Clapper | 297/452.41 |
| 6,901,617 | B2 * | 6/2005 | Sprouse et al. | 5/654 |
| 7,159,258 | B2 * | 1/2007 | Huang | 5/636 |
| 7,819,484 | B2 * | 10/2010 | Conforti | 297/452.21 |
| 7,946,654 | B2 * | 5/2011 | Tsuber et al. | 297/452.21 |
| 8,087,726 | B2 * | 1/2012 | Chen | 297/284.5 |
| 8,910,334 | B2 * | 12/2014 | Lafleche et al. | 5/713 |
| 8,979,207 | B2 * | 3/2015 | Bachar | 297/452.41 |
| 9,096,158 | B2 * | 8/2015 | Herbst | 1/1 |
| 2002/0129449 | A1 * | 9/2002 | Harker | 5/726 |
| 2004/0237203 | A1 * | 12/2004 | Romano et al. | 5/713 |
| 2005/0151410 | A1 * | 7/2005 | Sprouse, II | 297/452.41 |
| 2007/0277320 | A1 * | 12/2007 | Massmann | 5/654 |
| 2010/0205749 | A1 * | 8/2010 | Huang | 5/710 |

* cited by examiner

*Primary Examiner* — Laurie Cranmer
(74) *Attorney, Agent, or Firm* — Birch, Stewart, Kolasch & Birch, LLP

(57) ABSTRACT

A cushion device for an exercising apparatus has a body, at least one air bag group and a covering group. The body has at least one mounting recess and a connecting recess. The at least one air bag group is mounted in the at least one mounting recess of the body, and each one of the at least one air bag group has a connecting panel and multiple airbags. The covering group is mounted around the body to hold the at least one air bag group in the body and has a top cover, a bottom panel and a side cover. The top cover is mounted on a top side of the body. The bottom panel is mounted in the connecting recess. The side cover is mounted around the body and is connected to the top cover and the bottom panel.

18 Claims, 6 Drawing Sheets

CUSHION DEVICE FOR AN EXERCISING APPARATUS

BACKGROUND OF THE INVENTION

1. Field of the Invention

The present invention relates to a cushion device, and more particularly to a cushion device for an exercising apparatus that can be used comfortably and can provide a ventilation effect to a user.

2. Description of Related Art

A conventional seat cushion or handrail cushion for an exercising apparatus is used fillers with hard material to be the contents of the conventional seat cushion or handrail cushion. When a user sits on the conventional seat cushion or leans on the handrail cushion for a long time, the fillers with hard material and impermeable, and the user may feel uncomfortable to use the exercising apparatus. Then, the user may reduce the number of using the exercising apparatus and this will influence the practicality of the exercising apparatus.

To overcome the shortcomings, the present invention tends to provide a cushion device for an exercising apparatus to mitigate the aforementioned problems.

SUMMARY OF THE INVENTION

The main objective of the present invention is to provide a cushion device for an exercising apparatus that can be used comfortably and can provide a ventilation effect to a user.

The cushion device for an exercising apparatus in accordance with the present invention has a body, at least one air bag group and a covering group. The body has at least one mounting recess and a connecting recess. The at least one air bag group is mounted in the at least one mounting recess of the body, and each one of the at least one air bag group has a connecting panel and multiple airbags. The covering group is mounted around the body to hold the at least one air bag group in the body and has a top cover, a bottom panel and a side cover. The top cover is mounted on a top side of the body. The bottom panel is mounted in the connecting recess. The side cover is mounted around the body and is connected to the top cover and the bottom panel.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
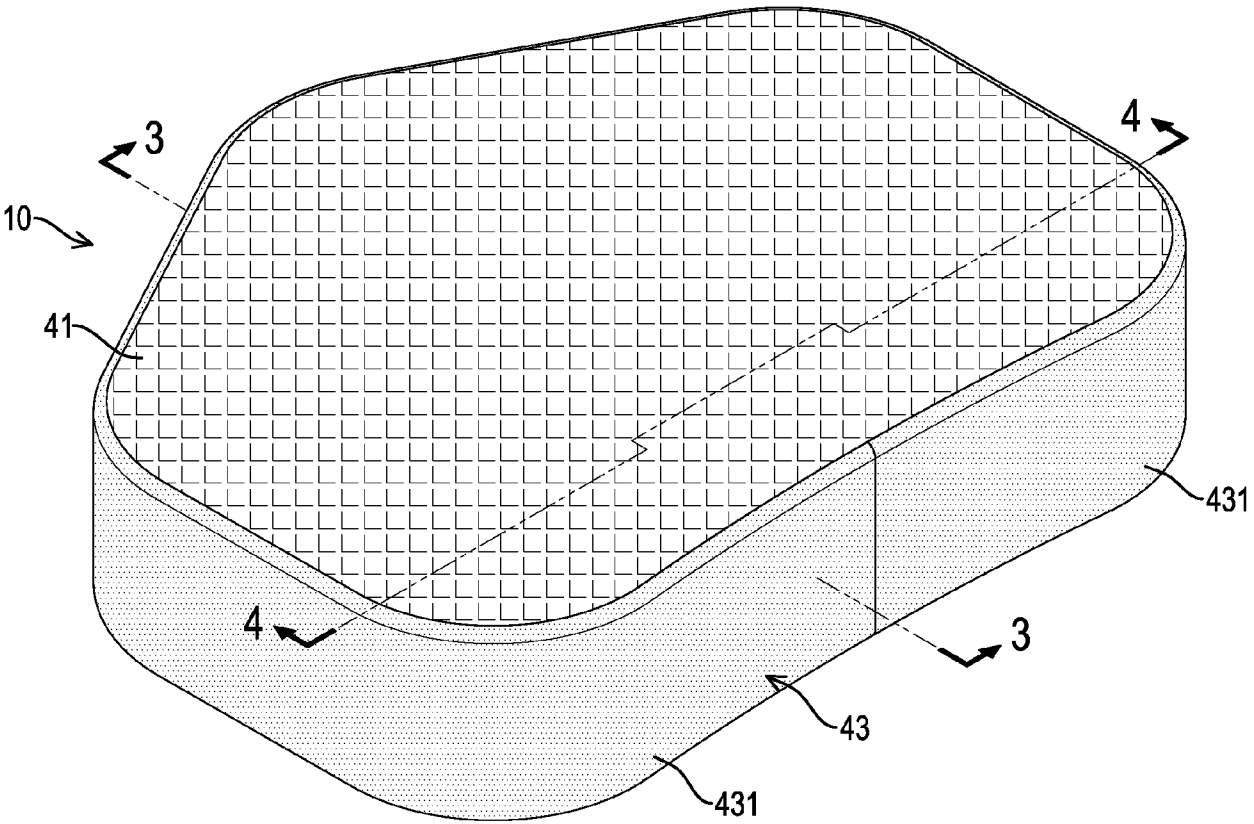
FIG. 1 is a perspective view of a cushion device for an exercising apparatus in accordance with the present invention.
Figures 2A, 2B:
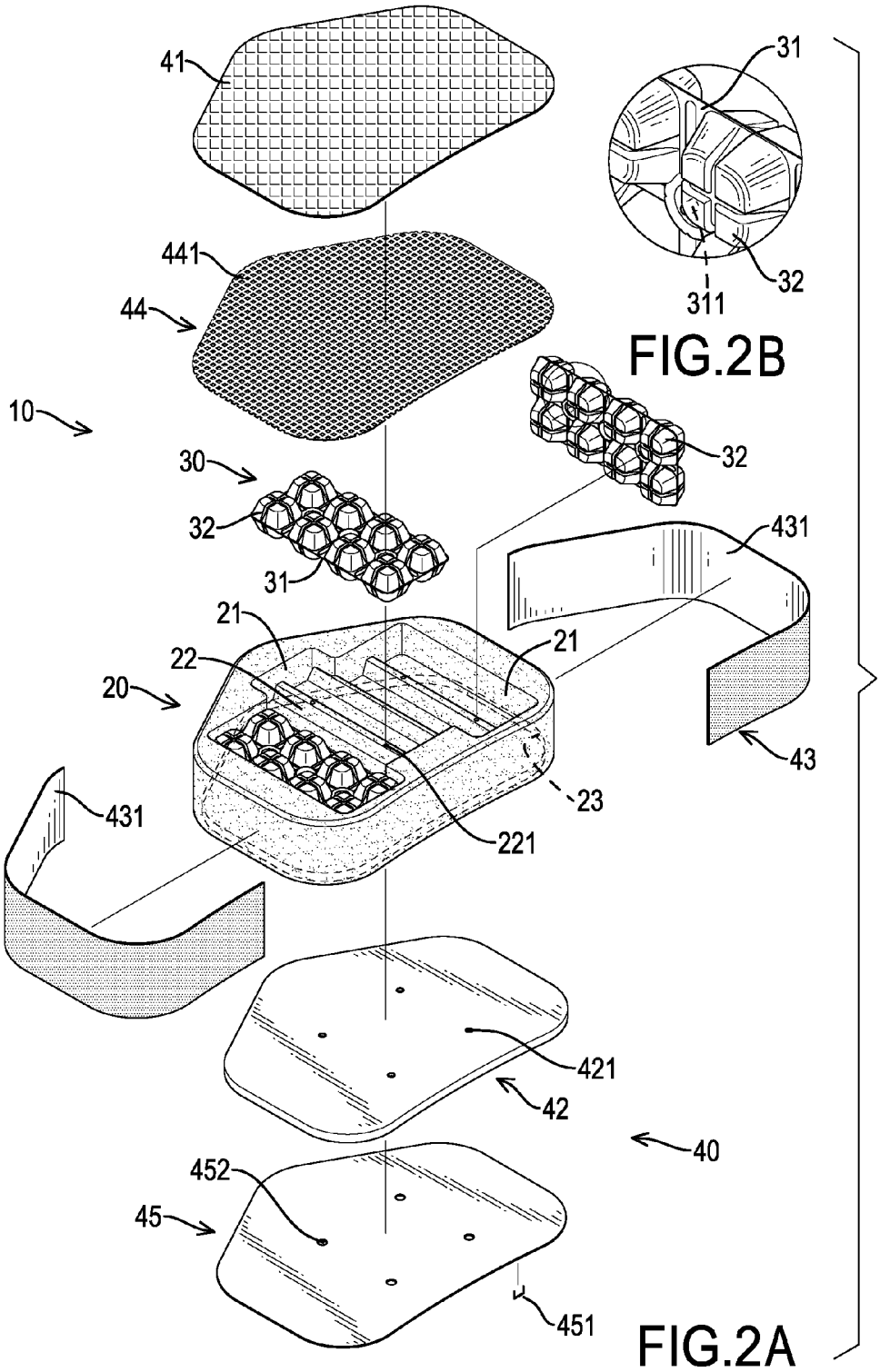
FIG. 2A is an exploded perspective view of the cushion device in FIG. 1.
FIG. 2B is an enlarged perspective view of an air bag group of the cushion device in FIG. 2A.

With reference to FIGS. 1, 2A, 2B and 3A, a cushion device 10 for an exercising apparatus in accordance with the present invention comprises a body 20, at least one air bag group 30 and a covering group 40.

The body 20 may be a seat cushion or a handrail cushion that is made of soft materials such as foam and has a top side, a bottom side, an external surface, at least one mounting recess 21 and a connecting recess 23. The at least one mounting recess 21 is formed through the top side of the body 20, is formed in the body 20 and has a bottom face, a middle and a positioning bar 22. Preferably, the body 20 has three mounting recesses 21 formed in the body 20 side by side. The positioning bar 22 is formed on and protrudes upwardly from the bottom face of the at least one mounting recess 21 at the middle of the at least one mounting recess 21 and has an upper face and multiple locating holes 221. The locating holes 221 are formed in the upper face of the positioning bar 22 at intervals. The connecting recess 23 is formed in the bottom side of the body 20. Preferably, the connecting recess 23 has a shape corresponding to a shape of the body 20.

The at least one air bag group 30 is mounted in the at least one mounting recess 21 of the body 20, and each one of the at least one air bag group 30 has a connecting panel 31 and multiple airbags 32. Preferably, the cushion device 10 has three air bag groups 30 respectively mounted in the three mounting recesses 21 of the body 20. The connecting panel 31 is mounted in the at least one mounting recess 21 and has a lower face, a top face, a middle and multiple positioning protrusions 331. The lower face of the connecting panel 31 is mounted above the positioning bar 22 that is formed in the at least one mounting recess 21. The positioning protrusions 331 are formed on and protrude downwardly from the lower face of the connecting panel 31 and are respectively mounted in the locating holes 221 of the positioning bar 22 to hold the connecting panel 31 in the at least one mounting recess 21.

The airbags 32 are hollow, are formed on the connecting panel 31 and are mounted in the at least one mounting recess 21. Each one of the airbags 32 may be square and has a top side and a bottom side. The top sides of the airbags 32 extend out of the top face of the connecting panel 31. The bottom sides of the airbags 32 extend out of the bottom face of the connecting panel 31. Preferably, each one of the at least one air bag group 30 has eight airbags 32 arranged in two rows at intervals and mounted on two opposite sides of the positioning bar 22 that is formed in the at least one mounting recess 21.

The covering group 40 is mounted around the body 20 to hold the at least one air bag group 30 in the body 20 and has a top cover 41, a bottom panel 42 and a side cover 43. The top cover 41 is mounted on the top side of the body 20 to cover the at least one mounting recess 21 to hold the at least one air bag group 30 between the body 20 and the top cover 41. Preferably, the covering group 40 has a ventilating layer 44 mounted between the top cover 41 and the top side of the body 20. The ventilating layer 44 has multiple ventilating holes 441 formed through the ventilating layer 44 and communicating with the at least one mounting recess 21.

The bottom panel 42 is made of hard material such as wood, is mounted in the connecting recess 23 of the body 20 and has a top side, a bottom side and multiple fixing tubes 421. The fixing tubes 421 are mounted in the bottom panel 42 at interval between the top side of the bottom panel 42 and the bottom side of the bottom panel 42, and each one of the fixing tubes 421 has an inner thread.

Figure 3B:
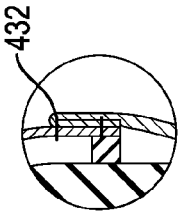
FIG. 3B is an enlarged side view of the cushion device in FIG. 3A.

The side cover 43 is mounted around the external surface of the body 20 and is connected to the top cover 41 and the bottom panel 42 to enable the covering group 40 to mount around the body 20. Preferably, the side cover 43 is formed by two half-sheets 431. In addition, with reference to FIG. 3B, the side cover 43 is connected to the top cover 41 by a suture 432 mounting through the top cover 41 and the side cover 43.

Furthermore, the covering group 40 has a bottom cover 45 mounted on the bottom side of the bottom panel 42 and connected to the side cover 43 and the bottom panel 43. The bottom cover 45 is securely connected to the bottom panel 42 and the side cover 43 by multiple staples 451 mounting through the bottom cover 45 and the side cover 43 and connecting to the bottom panel 42. In addition, the bottom cover 45 has multiple through holes 452 formed through the bottom cover 45 and respectively aligning with the fixing tubes 421 of the bottom panel 42.

Figure 3A:
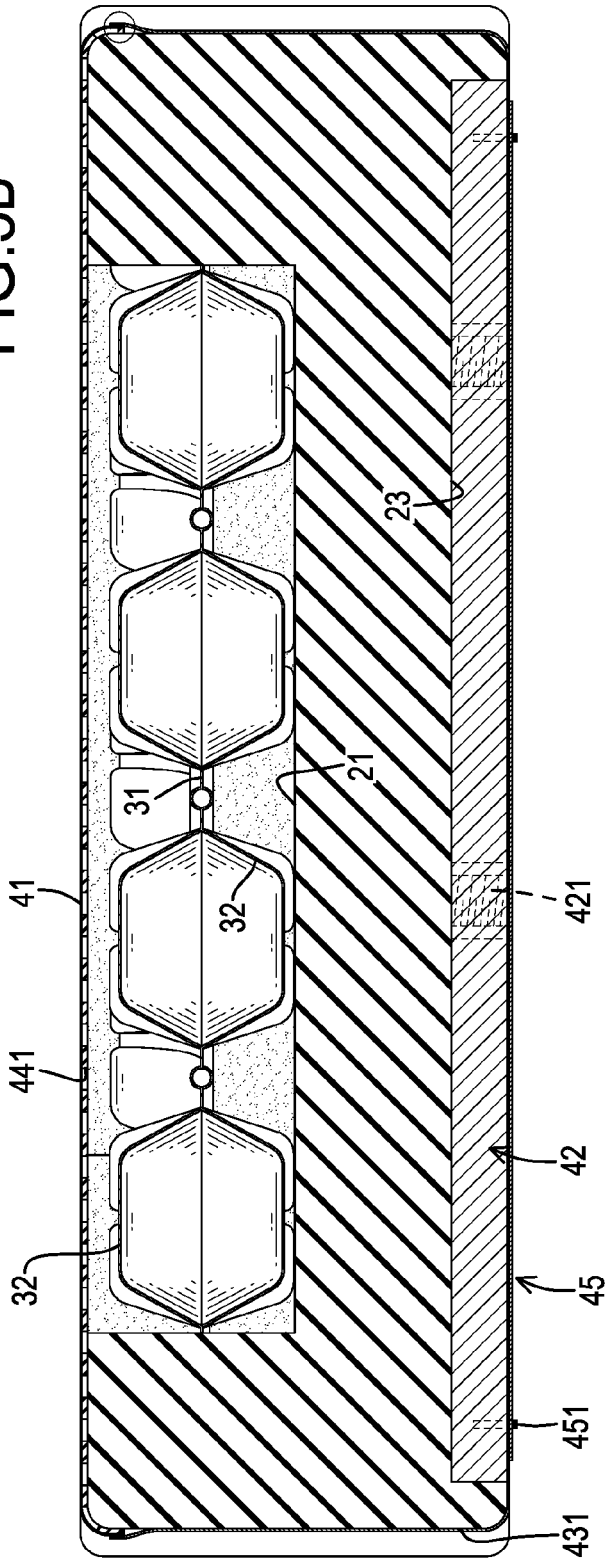
FIG. 3A is an enlarged cross sectional side view of the cushion device along line 3-3 in FIG. 1.
Figure 4:
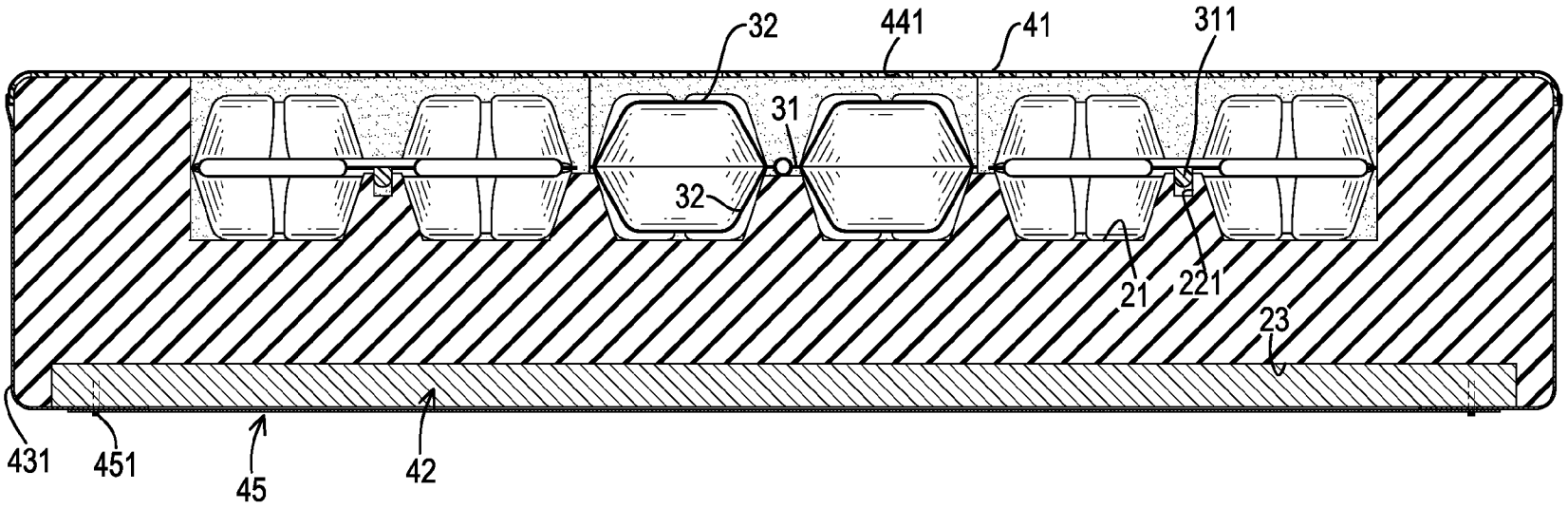
FIG. 4 is an enlarged cross sectional side view of the cushion device along line 4-4 in FIG. 1.
Figure 5:
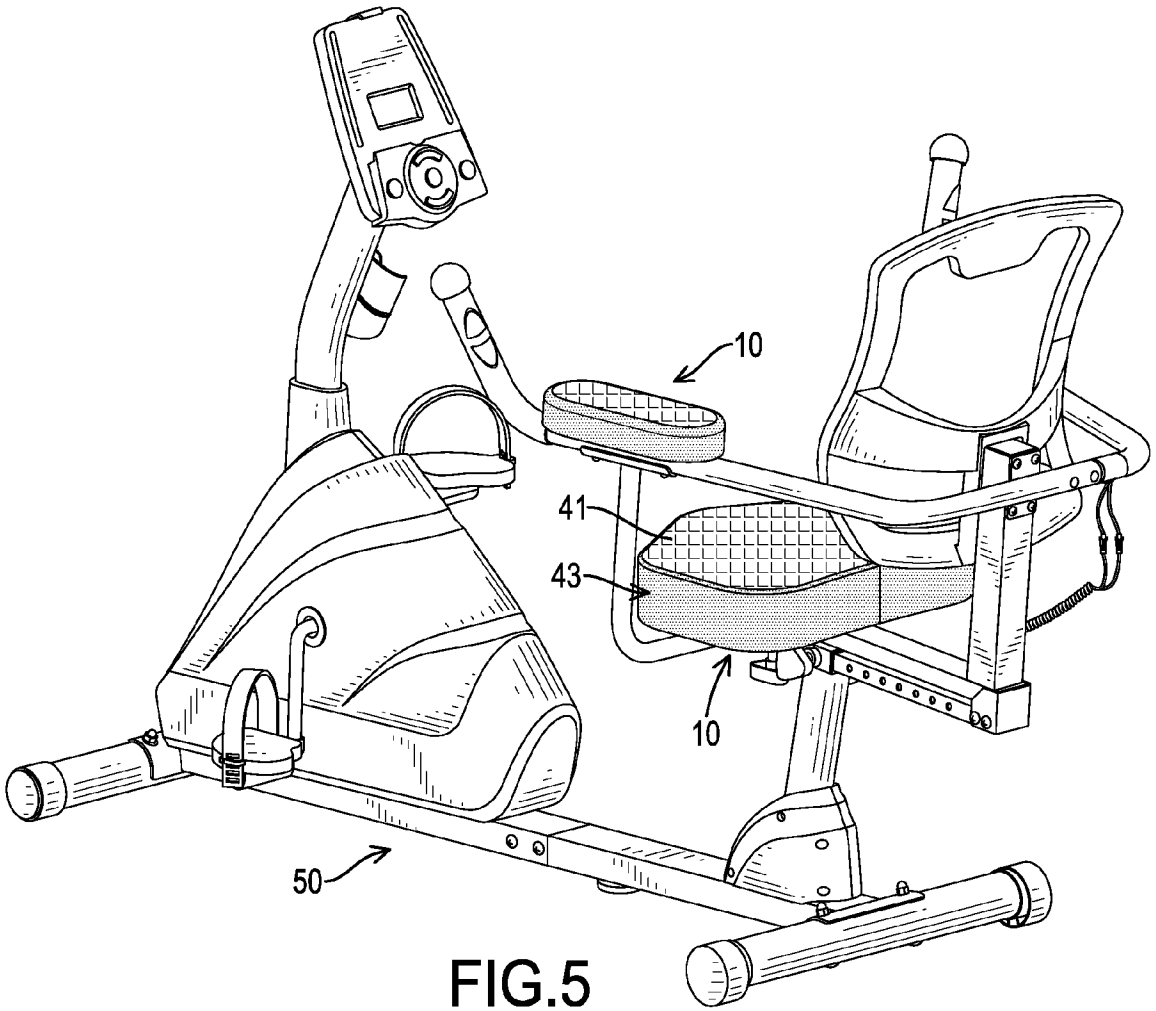
FIG. 5 is an operational perspective of the cushion device in FIG. 1 for a horizontal type exercising apparatus.
Figure 6:
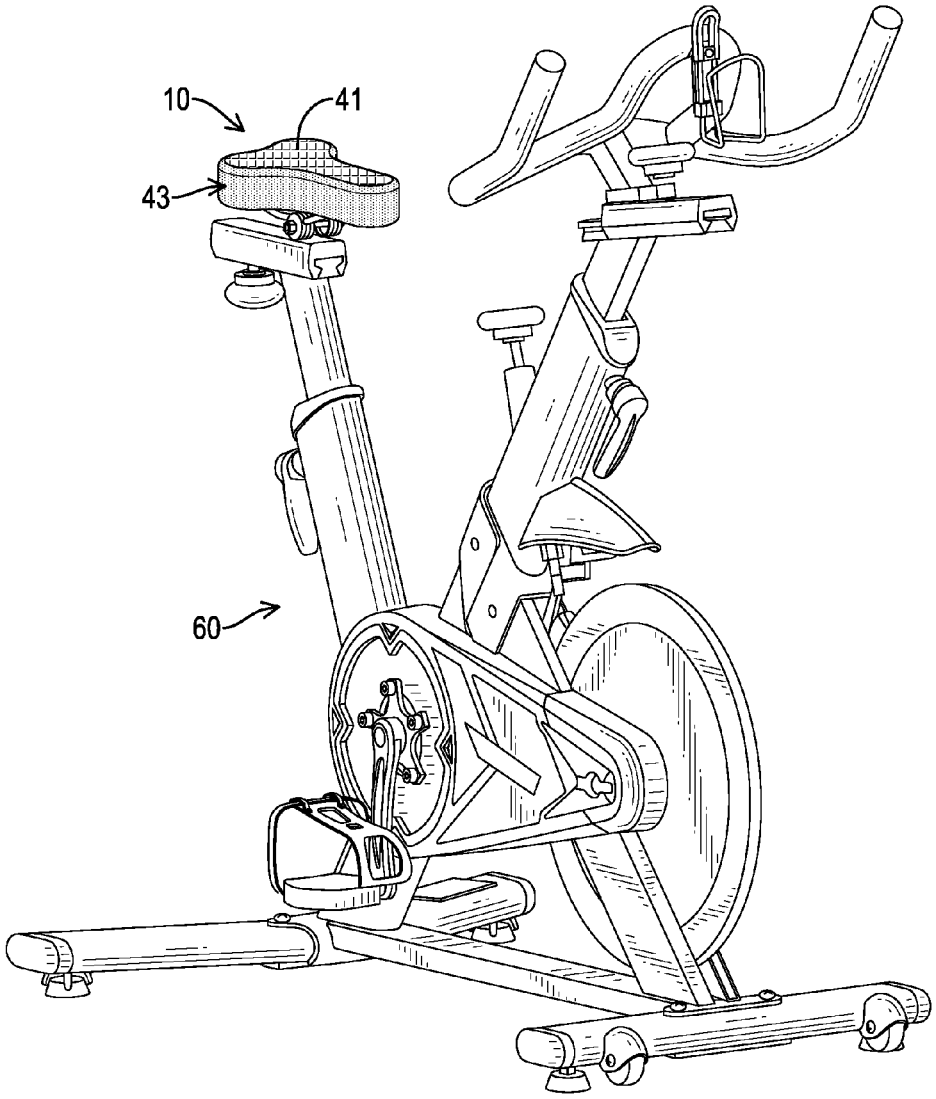
FIG. 6 is an operational perspective of the cushion device in FIG. 1 for a vertical type exercising apparatus.

In use, with reference to FIGS. 5 and 6, the cushion device 10 can be used as a seat cushion or a handrail cushion and can be mounted on a horizontal type exercising bike 50 or a vertical type exercising bike 60. With further reference to FIGS. 3A and 4, the cushion device 10 can be securely mounted on the exercising bikes 50, 60 by multiple bolts mounting through the exercising bikes 50, 60 and connecting to the fixing tubes 421 of the bottom panel 42. When a user sits or leans on the cushion device 10, the airbags 32 of the at least one air bag group 30 can be elastically deformed and this can provide a comfortable and dynamic weight supporting effect to the user's body. Additionally, the airbags 32 are formed on the connecting panel 31 at intervals and this can provide a space between the body 20 and the user's body to prevent the body 20 from completely contacting the user's body. Then, the space can be used to cool the heat that is produced from the user and so that user can sit or lean on the cushion device 10 for a long time without feeling discomfort.

Furthermore, the ventilating layer 44 that is mounted between the top cover 41 and the body 20 not only can provide supporting effect to the top cover 41 and also can enable the user's heat to flow between the at least one mounting recess 21 and the at least one air bag group 30 via the ventilating holes 441. Then, the user can use the exercising bikes 50, 60 comfortably by sitting or leaning on the cushion device 10, and this also can increase the number of using the exercising bikes 50, 60 and can improve the practicality of the exercising bikes 50, 60.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cushion device for an exercising apparatus having:
- a body having
  - a top side;
  - a bottom side;
  - an external surface;
  - at least one mounting recess formed through the top side of the body and formed in the body; and
  - a connecting recess formed in the bottom side of the body;
- at least one air bag group mounted in the at least one mounting recess of the body, and each one of the at least one air bag group having
  - a connecting panel mounted in the at least one mounting recess and having a lower face and a top face; and
  - multiple airbags being hollow, formed on the connecting panel and mounted in the at least one mounting recess, and each one of the airbags having
    - a top side extending out of the top face of the connecting panel; and
    - a bottom side extending out of the bottom face of the connecting panel; and
- a covering group mounted around the body to hold the at least one air bag group in the body and having
  - a top cover mounted on the top side of the body to cover the at least one mounting recess to hold the at least one air bag group between the body and the top cover;
  - a bottom panel mounted in the connecting recess of the body; and
  - a side cover mounted around the external surface of the body and connected to the top cover and the bottom panel to enable the covering group to mount around the body.

2. The cushion device as claimed in claim 1, wherein
- the at least one mounting recess of the body has
  - a bottom face;
  - a middle; and
  - a positioning bar formed on and protruding upwardly from the bottom face of the at least one mounting recess at the middle of the at least one mounting recess and having
    - an upper face; and
    - multiple locating holes formed in the upper face of the positioning bar at intervals; and
- the connecting panel of the at least one air bag group has
  - a middle; and
  - multiple positioning protrusions formed on and protruding downwardly from the lower face of the connecting panel and respectively mounted in the locating holes of the positioning bar to hold the connecting panel in the at least one mounting recess.

3. The cushion device as claimed in claim 2, wherein
- the covering group has a ventilating layer mounted between the top cover and the top side of the body; and
- the ventilating layer has multiple ventilating holes formed through the ventilating layer and communicating with the at least one mounting recess.

4. The cushion device as claimed in claim 3, wherein the covering group has a bottom cover mounted on the bottom side of the bottom panel and connected to the side cover and the bottom panel.

5. The cushion device as claimed in claim 4, wherein the bottom cover is securely connected to the bottom panel and the side cover by multiple staples mounting through the bottom cover and the side cover and connecting to the bottom panel.

6. The cushion device as claimed in claim 5, wherein
- the bottom panel has
  - a top side;
  - a bottom side; and
  - multiple fixing tubes mounted in the bottom panel at interval between the top side of the bottom panel and the bottom side of the bottom panel, and each one of the fixing tubes having an inner thread; and
- the bottom cover has multiple through holes formed through the bottom cover and respectively aligning with the fixing tubes of the bottom panel.

7. The cushion device as claimed in claim 6, wherein the side cover is formed by two half-sheets.

8. The cushion device as claimed in claim 7, wherein the side cover is connected to the top cover by a suture mounting through the top cover and the side cover.

9. The cushion device as claimed in claim 8, wherein the body has three mounting recesses formed in the body side by side; and the cushion device has three air bag groups respectively mounted in the three mounting recesses of the body.

10. The cushion device as claimed in claim 9, wherein each one of the at least one air bag group has eight airbags arranged in two rows at intervals and mounted on two opposite sides of the positioning bar that is formed in the at least one mounting recess.

11. The cushion device as claimed in claim 1, wherein the covering group has a ventilating layer mounted between the top cover and the top side of the body; and the ventilating layer has multiple ventilating holes formed through the ventilating layer and communicating with the at least one mounting recess.

12. The cushion device as claimed in claim 11, wherein the covering group has a bottom cover mounted on the bottom side of the bottom panel and connected to the side cover and the bottom panel.

13. The cushion device as claimed in claim 12, wherein the bottom cover is securely connected to the bottom panel and the side cover by multiple staples mounting through the bottom cover and the side cover and connecting to the bottom panel.

14. The cushion device as claimed in claim 13, wherein the bottom panel has a top side;

a bottom side; and multiple fixing tubes mounted in the bottom panel at interval between the top side of the bottom panel and the bottom side of the bottom panel, and each one of the fixing tubes having an inner thread; and the bottom cover has multiple through holes formed through the bottom cover and respectively aligning with the fixing tubes of the bottom panel.

15. The cushion device as claimed in claim 14, wherein the side cover is formed by two half-sheets.

16. The cushion device as claimed in claim 15, wherein the side cover is connected to the top cover by a suture mounting through the top cover and the side cover.

17. The cushion device as claimed in claim 16, wherein the body has three mounting recesses formed in the body side by side; and the cushion device has three air bag groups respectively mounted in the three mounting recesses of the body.

18. The cushion device as claimed in claim 17, wherein each one of the at least one air bag group has eight airbags arranged in two rows at intervals and mounted on two opposite sides of the positioning bar that is formed in the at least one mounting recess.

* * * * *